US011207894B2

(12) United States Patent
Choy

(10) Patent No.: US 11,207,894 B2
(45) Date of Patent: Dec. 28, 2021

(54) BUBBLERS TO PROVIDE SEQUENTIAL FLUID FLOW

(71) Applicant: HEWLETT-PACKARD DEVELOPMENT COMPANY, L.P., Spring, TX (US)

(72) Inventor: Si-lam Choy, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/045,208

(22) PCT Filed: Apr. 6, 2018

(86) PCT No.: PCT/US2018/026509

§ 371 (c)(1),
(2) Date: Oct. 5, 2020

(87) PCT Pub. No.: WO2019/194820

PCT Pub. Date: Oct. 10, 2019

(65) Prior Publication Data

US 2021/0162767 A1 Jun. 3, 2021

(51) Int. Cl.
*B41J 2/175* (2006.01)
*B41J 2/045* (2006.01)

(52) U.S. Cl.
CPC ..... *B41J 2/17596* (2013.01); *B41J 2/0458* (2013.01); *B41J 2/17513* (2013.01)

(58) Field of Classification Search
CPC .... B41J 2/17513; B41J 2/17596; B41J 2/175; B41J 2/0458; B41J 2/18
See application file for complete search history.

(56) References Cited

U.S. PATENT DOCUMENTS

| | | | |
|---|---|---|---|
| 4,734,706 | A | 3/1988 | Le |
| 5,423,226 | A | 6/1995 | Hunter et al. |
| 5,815,172 | A | 9/1998 | Moh |
| 6,065,864 | A | 5/2000 | Evans et al. |
| 6,360,775 | B1 | 3/2002 | Barth et al. |
| 6,843,281 | B1 | 1/2005 | Barth et al. |
| 6,877,528 | B2 | 4/2005 | Gilbert et al. |
| 7,467,858 | B2 | 12/2008 | Lebron et al. |

(Continued)

FOREIGN PATENT DOCUMENTS

| | | | |
|---|---|---|---|
| EP | 2347905 | A2 | 7/2011 |
| WO | WO-2017052625 | A1 | 3/2017 |

*Primary Examiner* — An H Do

(74) *Attorney, Agent, or Firm* — Perry + Currier Inc

(57) ABSTRACT

An example device includes a first chamber to contain a first fluid and a second chamber to contain a second fluid. The first chamber includes a first fluid outlet, and a first bubbler to ingest bubbles into the first chamber when pressure in the first chamber overcomes a first bubble pressure of the first bubbler. The second chamber includes a second fluid outlet, and a second bubbler to ingest bubbles into the second chamber when pressure in the first chamber overcomes a second bubble pressure of the second bubbler. An outlet node is fluidly connected to the first fluid outlet and the second fluid outlet. The outlet node draws the first fluid from the first chamber when the first bubbler ingests bubbles, and sequentially draws the second fluid from the second chamber when the second bubbler ingests bubbles.

15 Claims, 8 Drawing Sheets

(56) References Cited

U.S. PATENT DOCUMENTS

| | | | | |
|---|---|---|---|---|
| 8,192,000 | B2 * | 6/2012 | Coffey | B41J 2/175 347/85 |
| 8,506,061 | B2 * | 8/2013 | Park | B41J 2/19 347/85 |
| 8,545,446 | B1 | 10/2013 | Butterfield | |
| 10,850,506 | B2 * | 12/2020 | Anderson | B41J 2/04555 |
| 2009/0309244 | A1 | 12/2009 | Da Vila Martin | |
| 2010/0085396 | A1 | 4/2010 | Yokota et al. | |
| 2011/0012945 | A1 | 1/2011 | Coffey | |
| 2012/0044303 | A1 | 2/2012 | Park | |
| 2013/0147879 | A1 | 6/2013 | Hays | |
| 2014/0263451 | A1 | 9/2014 | Ross et al. | |

* cited by examiner

BUBBLERS TO PROVIDE SEQUENTIAL FLUID FLOW

BACKGROUND

Microfluidics involves the manipulation of fluids constrained within small volumes. Such fluids may be moved, mixed, separated, or otherwise processed through small chambers, channels, or other small components.

Applications of microfluidics include high-throughput screening of fluids for testing, conducting lab-on-a-chip operations, and the delivery of ink through inkjet printheads. The flow of fluid on such devices may be controlled by active components such as microvalves and micropumps.

DETAILED DESCRIPTION

Devices in which fluids are to be sequentially drawn from different chambers may operate by selectively blocking fluid flow from a chamber while permitting fluid flow from another chamber. Fluid flow may be blocked or permitted, for example, through the use of active mechanisms such as a valves and pumps, which may be situated at the outlets of such chambers. However, active mechanisms may add bulk and complexity to devices. In addition, active mechanisms often need power and control signals to operate, which add further complexity to microfluidic devices.

A device may provide sequential output of fluids from chambers using bubblers, and the use of an active mechanism may not be required. Fluid-filled chambers may be provided with associated bubblers. A bubbler, which may also be termed a bubble generator, may be preconfigured to ingest bubbles, and thus to initiate discharge of fluid from its associated chamber, when a bubble pressure of the bubbler is overcome, A bubbler may passively switch fluid flow from a chamber between binary on/off states.

Different bubblers may be set to dispense fluid at different pressures. Thus, the chambers may be configured to dispense fluid in a pre-determined sequence in accordance with the bubble pressures of each bubbler. Switching of fluid flow may therefore be automatically controlled without the need for active mechanisms such as valves or pumps.

Figure 1:
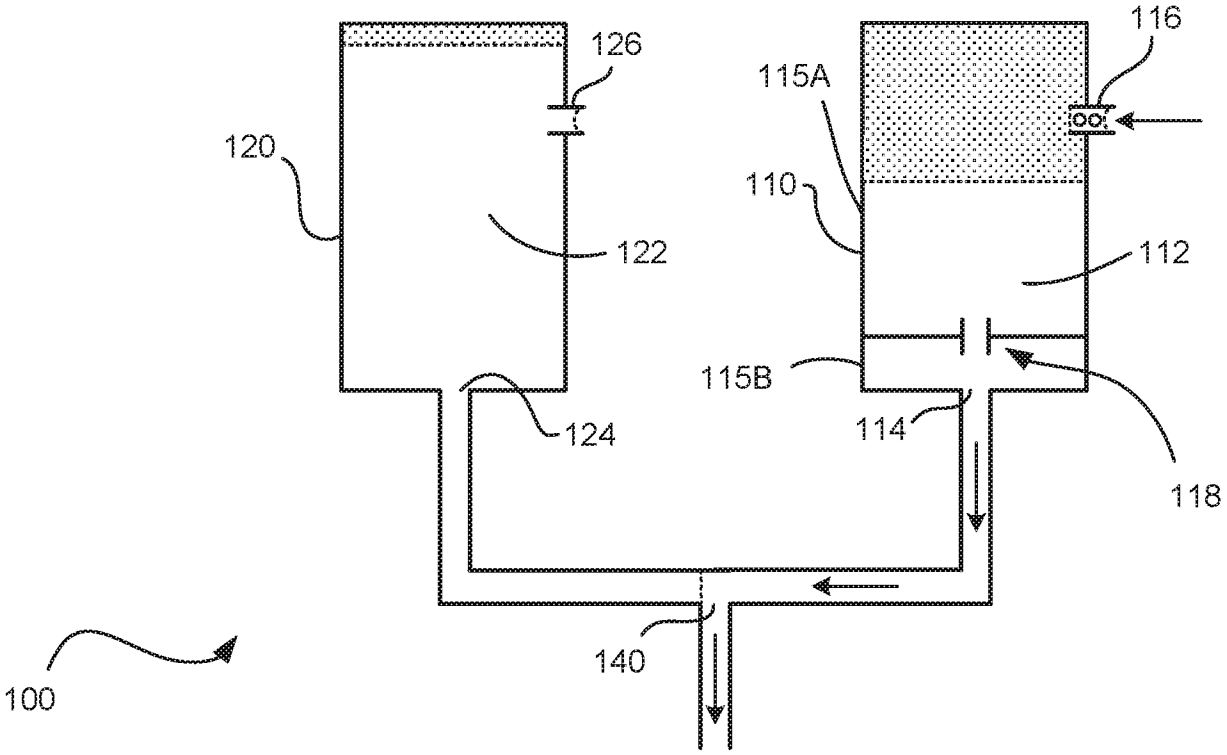
FIG. 1 is a schematic diagram of an example device that uses bubblers to provide sequential fluid flow.

FIG. 1 is a schematic diagram of an example of such a device. In FIG. 1, a device 100 includes a first chamber 110, which contains a first fluid 112, and a second chamber 120 which contains a second fluid 122. The first chamber 110 includes a first fluid outlet 114, and the second chamber 120 includes a second fluid outlet 124. In the example depicted, gas/air inside a device is illustrated as dotted stippling and liquid is illustrated as solid white.

The outlets 114, 124, are connected in parallel to an outlet node 140 via fluid conduits or similar structure. The first fluid 112 and second fluid 122, are thereby in fluid communication between the first chamber 110, second chamber 120, and outlet node 140. The fluid pressure at any point in the system of fluids may be the same at equilibrium, ignoring the effect of different fluid heads in each chamber. When fluid decreases at the outlet node 140 by some downstream low-pressure element, the pressure in the first chamber 110 and second chamber 120 also decrease. The low-pressure element may be a passive element such as an opening, a downstream constriction causing a Venturi effect, a fluidly connected tube at sufficiently low head, or an active element such as a downstream pump or an active valve.

The first chamber 110 includes a first bubbler 116 to ingest bubbles into the first chamber 110 when pressure of the first fluid 112 in the first chamber 110 decreases, so as to overcome a bubble pressure of the bubbler 116. When the bubble pressure is overcome and the bubbler 116 is ingesting bubbles, the first fluid 112 is drawn from the first chamber 110 through the first fluid outlet 114 and out the outlet node 140.

The bubble pressure of the first bubbler 116 is overcome by a pressure differential across a capillary meniscus formed in the first bubbler 116 between the pressure in the first chamber 110 and the pressure of fluid outside the first bubbler 116. The first bubbler 116 and a second bubbler 126 may both be open to a common fluid, such as, for example, atmospheric air at atmospheric pressure.

In some examples, the first bubbler 116 may include a hole, channel, slit, or other orifice, or a plurality thereof. An orifice may be created in a wall of the first chamber 110 by laser cutting, drilling, water jetting, etching, or another similar technique. In other examples, the first bubbler 116 may include a bubbling assembly embedded in a wall, such as a channel pressed into a hole in a wall of the chamber 110. A ball or plug may be situated in the channel, which may permit bubbles to pass through the channel. In other examples, the first bubbler 116 may include an orifice or channel having packed objects therein, such as beads, flakes, or spheres, which may permit bubbles to pass through.

When the fluid inside a chamber is a liquid, and the fluid outside the bubbler is air, the bubbler may include a liquid-air interface which creates a capillary meniscus which ingests air bubbles into the liquid in the chamber when the surface tension of the capillary meniscus is overcome.

Where the bubbler includes an orifice of circular cross-section, the bubble pressure (P) of the orifice is related to the radius (r) of the orifice, the surface tension (γ) of the liquid, and the contact angle (θ) of the liquid to the surface, by the following equation:

$$P = \frac{2\gamma\cos\theta}{r}$$

When using the term bubble pressure, which may also be termed the bubble point pressure or the capillary pressure, it is understood that the bubble pressure of a bubbler is overcome when the pressure of the fluid in the chamber drops below the outside pressure by an amount of pressure that breaches the capillary meniscus of the bubbler according to the above equation. Thus, where a first bubbler is set at a first bubble pressure, and where the pressure of the fluid in the associated first chamber drops below the first bubble pressure, a bubble is forced through the first bubbler and into the first chamber, and fluid flows from the first chamber. Where a second bubbler is to discharge fluid sequentially after the first bubbler, the second bubbler is said to be set at a higher bubble pressure, where its capillary meniscus provides greater bubble pressure than in the first bubbler. In other words, as pressure in the system decreases, bubblers with increasing bubble pressure are triggered.

The pressure of fluid in the chambers may be caused to decrease in different ways. For example, the pressure of a fluid in a chamber may drop when a downstream pump is activated. Where a downstream pump is activated, pressure upstream of the pump decreases. As this suction increases, pressure in the upstream fluid correspondingly decreases. Thus, it is understood that the bubble pressure of a bubbler is overcome when the suction acting on the fluid overcomes the bubble pressure of the bubbler, and as suction in the system increases, bubblers with increasing bubble pressures are triggered. For example, with 1.00 atmosphere of pressure outside a chamber and with a bubbler having a bubble pressure of 0.05 atmospheres, flow from the chamber occurs when the relative suction applied to the chamber exceeds 0.05 atmospheres (or the chamber pressure falls below 0.95 atmospheres absolute).

The second chamber 120 includes a second bubbler 126. The second bubbler 126 may be similar or identical to the first bubbler 116 of first chamber 110, and the above description of the first bubbler 116 may be referenced. The second bubbler 126 has a greater bubble pressure to the ingestion of bubbles than the first bubbler 116. Thus, as the pressure of the fluids 112, 122 decreases, the first bubbler 116 ingests bubbles first, and thus initiates fluid flow from the first chamber 110 first, before the second bubbler 126 initiates fluid flow from the second chamber 120. Thus, fluid is drawn first from the first chamber 110, and then fluid is sequentially drawn from the second chamber 120. Fluid flow is switched from the first chamber 110 to the second chamber 120 automatically without the need of an active valve or similar mechanism to switch between blocking and permitting fluid flow.

The first chamber 110 may be divided into two sub-chambers 115A, 1158 in fluid communication with one another through an intermediate bubbler 118, or other similar passive stopping mechanism. The intermediate bubbler 118 may be of the same type as the first bubbler 116, such as an orifice. The intermediate bubbler 118 may also be a mesh or a plurality of orifices.

An intermediate bubbler 118 may include a mesh filter or another filter capable of filtering contaminants from fluid passing through its associated chamber. A filter may include a metal mesh, tangled fibers, open cell foam, or the like. Thus, an intermediate bubbler may act as a bubbler when it forms an air-liquid interface and act as a filter when wetted.

The intermediate bubbler 118 has a bubble pressure greater than the bubble pressure of the first bubbler 116. Thus, the intermediate bubbler 118 stops flow of the first fluid 112 when the sub-chamber 115A is drained. Further, the intermediate bubbler 118 has a bubble pressure greater than the bubble pressure of the second bubbler 126, and thus a portion of the first fluid 112 is retained in sub-chamber 1158 of the first chamber 110, and in fluid communication with the outlet node 140, during drawing of the second fluid 122 from the second chamber 120.

Figure 2:
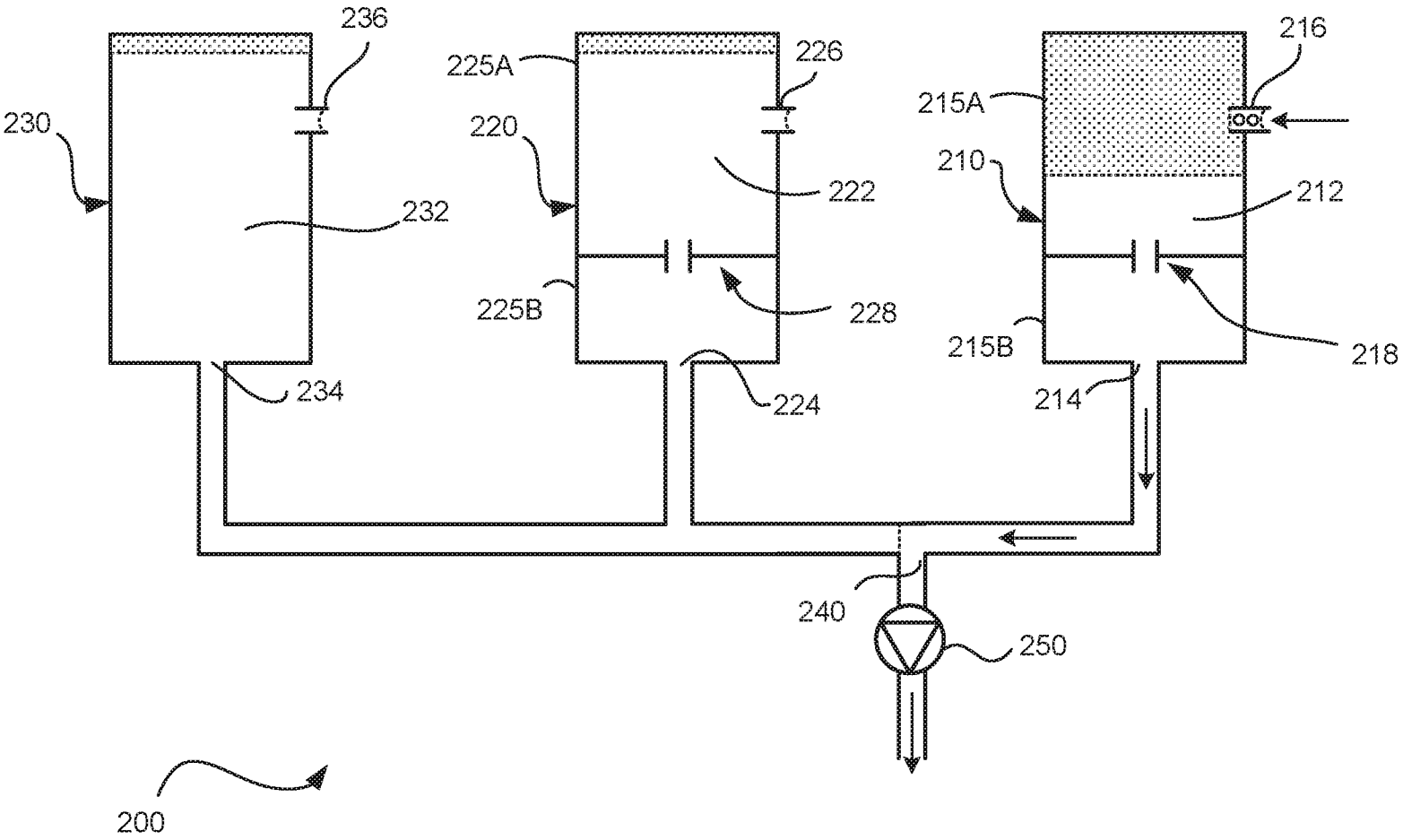
FIG. 2 is a schematic diagram of another example device that uses bubblers to provide sequential fluid flow.

FIG. 2 is a schematic diagram of another example device 200. The device 200 includes a first chamber 210 containing a first fluid 212 and having a first fluid outlet 214 and first bubbler 216. Similarly, the device 200 includes a second chamber 220 containing a second fluid 222 and having a second fluid outlet 224 and second bubbler 226. Similarly, the device 200 further includes a third chamber 230 containing a third fluid 232 and having a third fluid outlet 234 and third bubbler 236. The chambers 210, 220, 230 are in parallel fluid communication with an outlet node 240. For further description of the above components of the device 200, the description of the device 100 of FIG. 1 may be referenced. For sake of clarity, only the differences between the device 200 and the device 100 will be described in detail.

The first chamber 210 may be divided into two sub-chambers 215A, 215B in fluid communication with one another through a first intermediate bubbler 218. The first intermediate bubbler 218 may be of the same type as the first bubbler 216, such as an orifice. The first intermediate bubbler 218 may also be a mesh or a plurality of orifices. Similarly, the second chamber 220 is divided into two sub-chambers 225A, 225B in fluid communication with one another through a second intermediate bubbler 228.

The bubblers 216, 226, 236, 218, and 228, are set at different sequentially increasing bubble pressures. The intermediate bubblers 218, 228, may be set at bubble pressures greater than the bubble pressures of the bubblers 216, 226, 236. Thus, the intermediate bubbler 218 may stop flow of the first fluid 212 while other fluids are flowing, and the intermediate bubbler 228 may stop flow of the second fluid 222 while other fluids are flowing. Thus, a portion of fluid 212 may be retained in fluid communication with the outlet node 240 during drawing of other fluids, and a portion of fluid 222 may be retained in fluid communication with the outlet node 240 during drawing of other fluid, so that a pump 250 of the device 200 is retained in fluid communication with the fluids to be drawn.

Fluid does not flow from the device 200 until pressure in the device 200 is at least sufficient to overcome the bubble pressure of the bubbler having the lowest bubble pressure. The device 200 may include a pump 250, downstream the outlet node 240, for generating suction until pressure in the device 200 sufficiently decreases such that one of the bubblers 216, 226, 236, 218, 228 is triggered. Once the pressure in the device 200 reaches the lowest bubble pressure, the capillary meniscus of that bubbler is breached, and air bubbles are ingested into its associated chamber, thus triggering discharge of fluid from that chamber.

Thus, as suction increases in the chambers 210, 220, 230, the bubblers 216, 226, 236, 218, and 228 are triggered to discharge fluid in a pre-determined order of increasing bubble pressure. The device 200 may thereby be pre-set to discharge different fluids in sequence without the need for active switching components such as valves or individual pumps for different chambers. In other examples, increasing suction may be generated by a low-pressure element other than a pump, such as an opening, a downstream constriction causing a Venturi effect, a fluidly-connected tube at sufficiently low head, or an active valve.

FIGS. 2 through 6 illustrate different stages of flow of fluid out of the device 200 given a particular sequence of bubblers. However, this particular sequence is not limiting, and it is emphasized that any number of bubblers may be set with an increasing sequence of bubble pressures of any given order. For example, one of the intermediate bubblers 218, 228, may be set at an intermediate bubble pressure between the bubble pressures of bubblers 216, 226, 236, such that fluid is retained against the intermediate bubbler 218, 228, in its associated chamber, while other chambers discharge. In FIG. 2, the first bubbler 216 is set to the lowest bubble pressure, and thus the first chamber 210 begins to discharge first.

Figure 3:
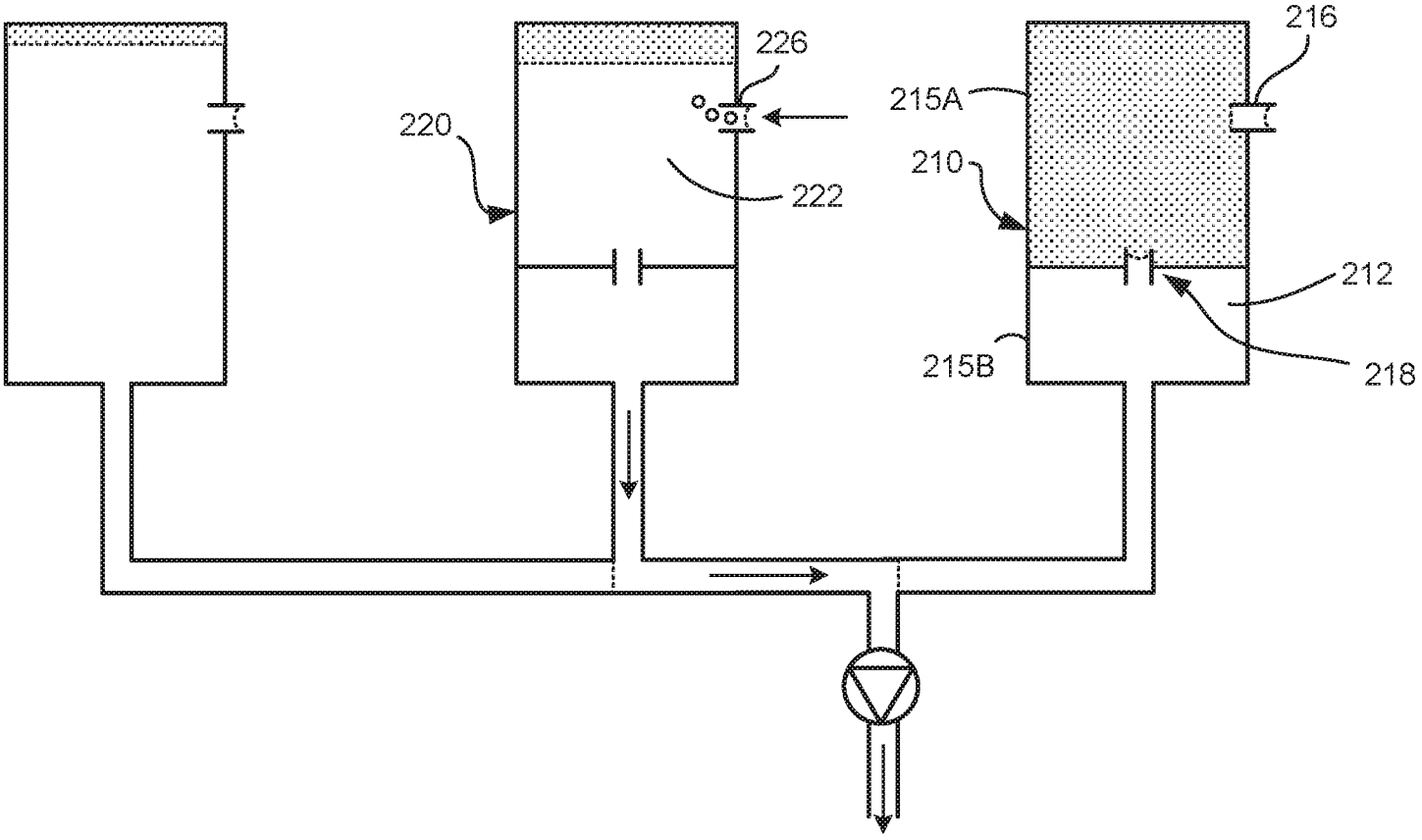
FIG. 3 is a schematic diagram of the example device of FIG. 2 at another stage of flow.

FIG. 3 is a schematic diagram of the device 200 of FIG. 2 at another stage of flow. In FIG. 3, a first sub-chamber 215A of a first chamber 210 has been depleted, and discharge of the first chamber 210 has stopped at a first intermediate bubbler 218, as the first intermediate bubbler 218 is set at a higher bubble pressure than a first bubbler 216. Further, a second bubbler 226 of a second chamber 220 has begun ingesting bubbles and causing a second chamber 220 to discharge its second fluid 222, as the bubble pressure of the second bubbler 226 is selected to be between the bubble pressures of the first intermediate bubbler 218 and the first bubbler 216. A portion of the first fluid 212 is retained in a second sub-chamber 215B of first chamber 210 during discharge of second chamber 220.

Figure 4:
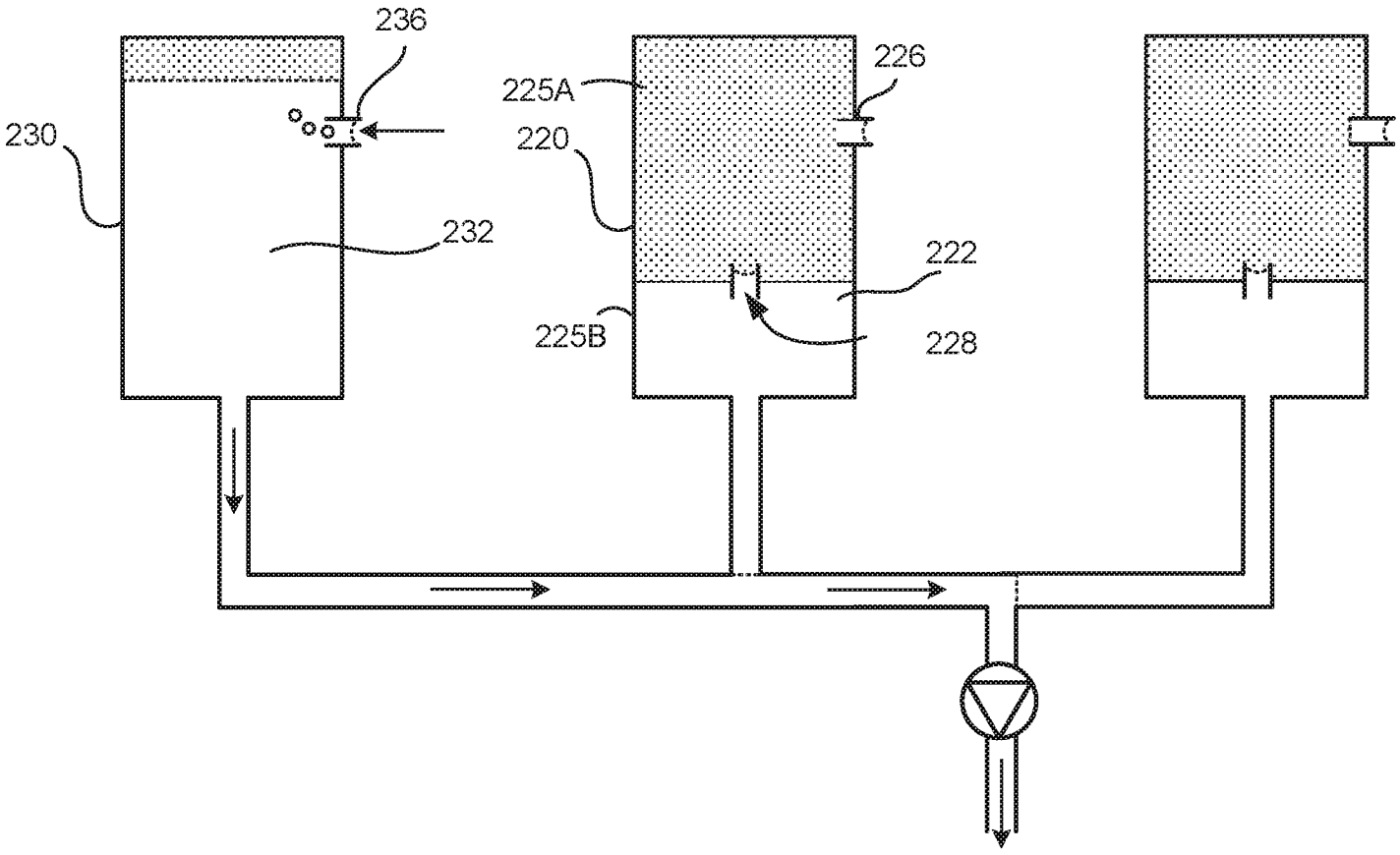
FIG. 4 is a schematic diagram of the example device of FIG. 2 at yet another stage of flow.

FIG. 4 is a schematic diagram of the device 200 of FIG. 2 at yet another stage of flow. In FIG. 4, a first portion of a second fluid 222 in a first sub-chamber 225A of a second chamber 220 has been discharged, and flow has stopped at a second intermediate bubbler 228, The second intermediate bubbler 228 is set at a higher bubble pressure than a second bubbler 226. Further, a third bubbler 236 of a third chamber 230 has begun ingesting bubbles and causing a third chamber 230 to discharge its third fluid 232, due to the relationship of bubble pressures of the third bubbler 236 and the second intermediate bubbler 228. I.e., the bubble pressure of the third bubbler 236 is lower than that of the second intermediate bubbler 228. A portion of the second fluid 222 is retained in a second sub-chamber 225B of the second chamber 220 during discharge of the third chamber 230.

Figure 5:
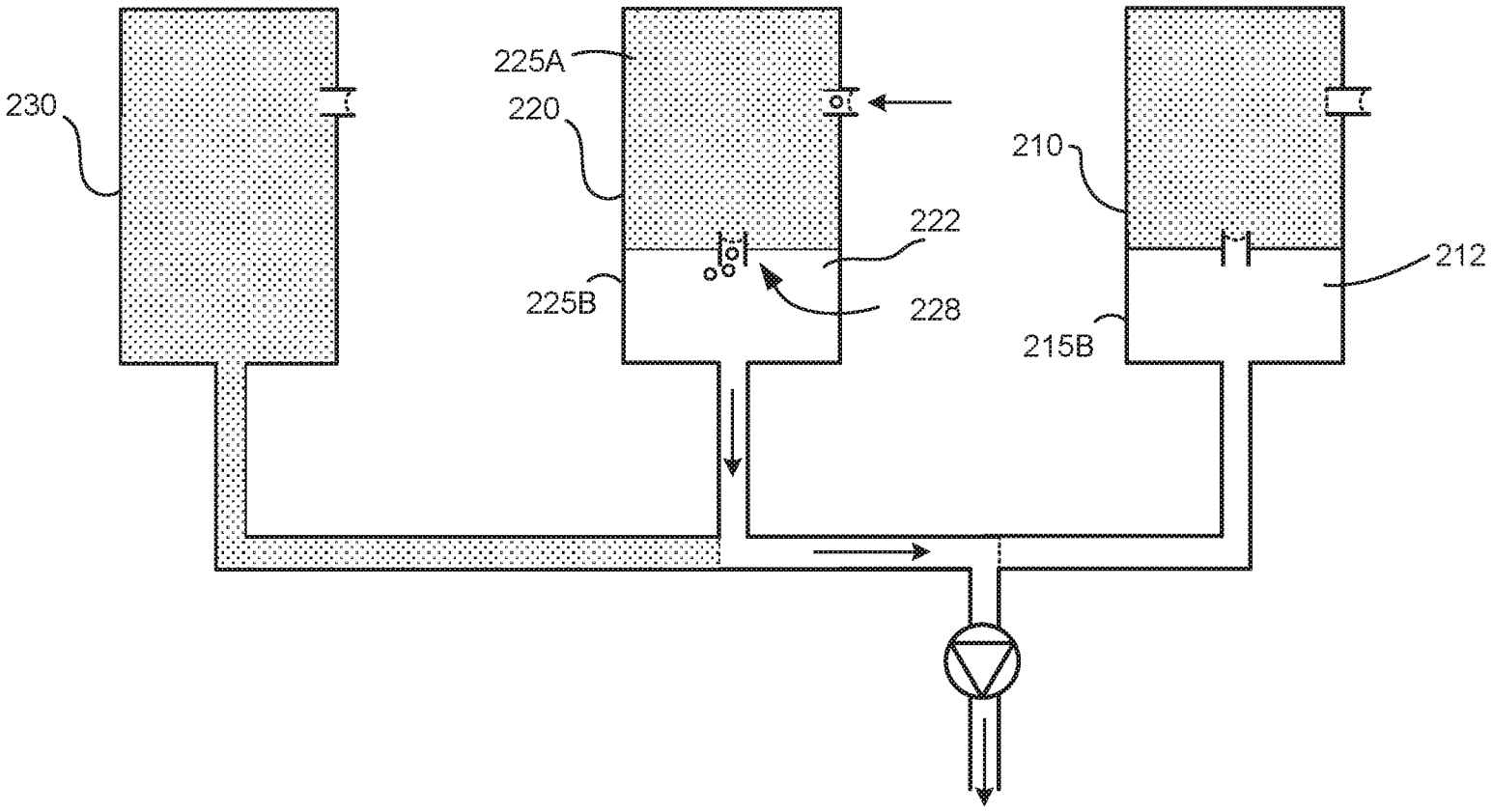
FIG. 5 is a schematic diagram of the example device of FIG. 2 at yet another stage of flow.

FIG. 5 is a schematic diagram of the device 200 of FIG. 2 at yet another stage of flow. In FIG. 5, a third chamber 230 has been depleted of fluid. Further, a second intermediate bubbler 228 has begun ingesting bubbles from a first sub-chamber 225A of a second chamber 220 and causing a second sub-chamber 225B of the second chamber 220 to discharge its second fluid 222. A portion of a first fluid 212 is retained in a second sub-chamber 215B of a first chamber 210 during discharge of the second chamber 220.

Figure 6:
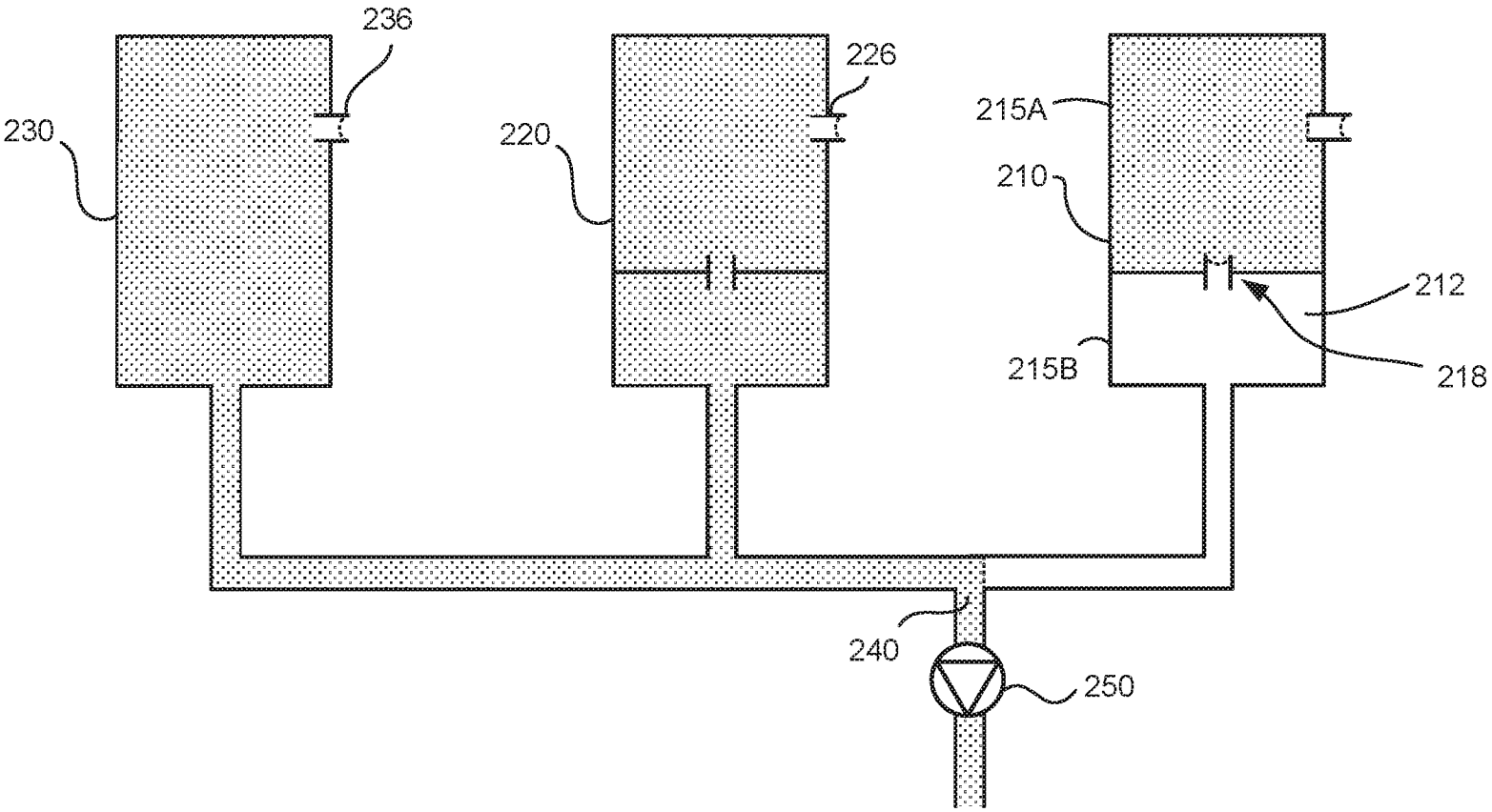
FIG. 6 is a schematic diagram of the example device of FIG. 2 when fluid flow is stopped.

FIG. 6 is a schematic diagram of the device 200 of FIG. 2 when fluid flow is stopped. In FIG. 6, a second chamber 220 and a third chamber 230 have been depleted of fluid, and an outlet node 240 and pump 250 are exposed to a common fluid open to bubblers 226 and 236, such as, for example, atmospheric air. Further, a first intermediate bubbler 218 has stopped fluid flow of a first fluid 212 from a second sub-chamber 215B of a first chamber 210. The pressure in chamber 210 may not be reduced to overcome the bubble pressure of first intermediate bubbler 218.

Thus, it may be seen from FIGS. 2 through 6 that a device may include a plurality of fluid communicating chambers having a plurality of associated bubblers, with the bubblers set at sequentially increasing bubble pressures. A bubbler may be positioned to control flow from an entire chamber or a sub-chamber within a chamber.

An intermediate bubbler, or other similar passive stopping mechanism, may be selectively located in a chamber to deplete a selected portion of fluid from the chamber. For example, an intermediate bubbler may be located nearer toward a fluid outlet of the chamber to deplete a larger portion of the fluid in the chamber, or may be located farther away from the fluid outlet to deplete a smaller portion of the fluid in the chamber.

A chamber or sub-chamber may be referred to as a volume. When pressure in the device reaches the lowest bubble pressure of the bubblers, the respective bubbler ingests bubbles and triggers discharge of fluid from its associated volume. When pressure in the device reaches the next lowest bubble pressure, the next bubbler is triggered in sequence. Different chambers and sub-chambers may thereby discharge fluid according to any selected sequence.

Figure 7:
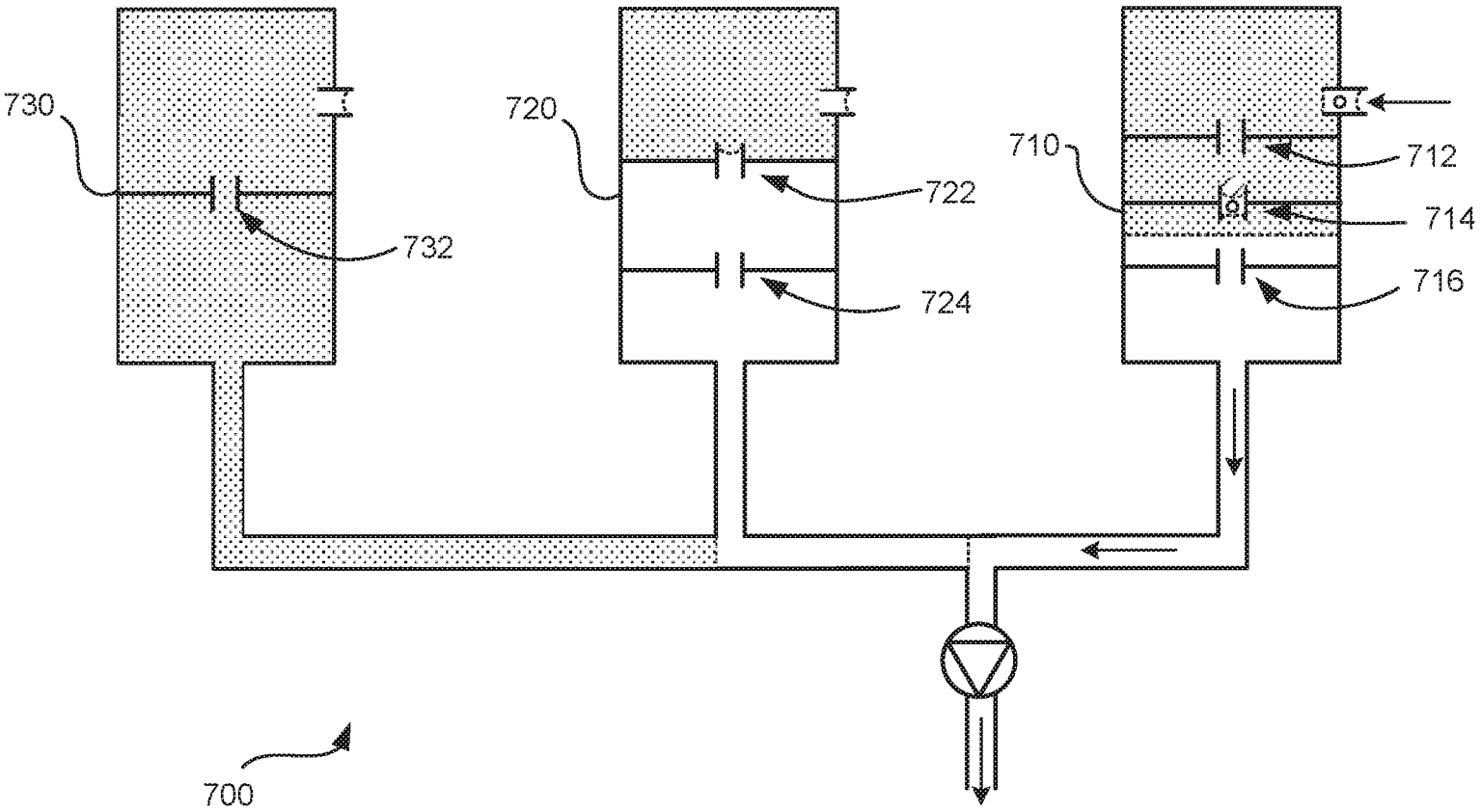
FIG. 7 is a schematic diagram of another example device that uses bubblers to provide sequential fluid flow.

FIG. 7 is a schematic diagram of another example device 700. The device 700 includes first, second, and third chambers 710, 720, and 730, respectively, which include components analogous to chambers 210, 220, and 230 of device 200. For sake of clarity, only differences between device 700 and device 200 will be described in detail. The description for device 200 may be referenced for description not repeated here.

The first chamber 710 includes a first intermediate bubbler 712, a second intermediate bubbler 714, and a third intermediate bubbler 716, dividing the first chamber 710 into four sub-chambers. The second chamber 720 includes a fourth intermediate bubbler 722 and a fifth intermediate bubbler 724, dividing the second chamber 720 into three sub-chambers. The third chamber 730 includes a sixth intermediate bubbler 732 dividing the third chamber 730 into two sub-chambers. The intermediate bubblers 712, 714, 716, 722, 724, 732 may be set at different bubble pressures. Thus, it may be seen that a chamber 710, 720, 730 may include a bubbler to start fluid flow from the chamber, an intermediate bubbler to stop fluid flow from the change, and any number of other intermediate bubblers set at different bubble pressures such that fluid flow from chambers may be initiated, stopped, and restarted, any given number of times.

Figure 8:
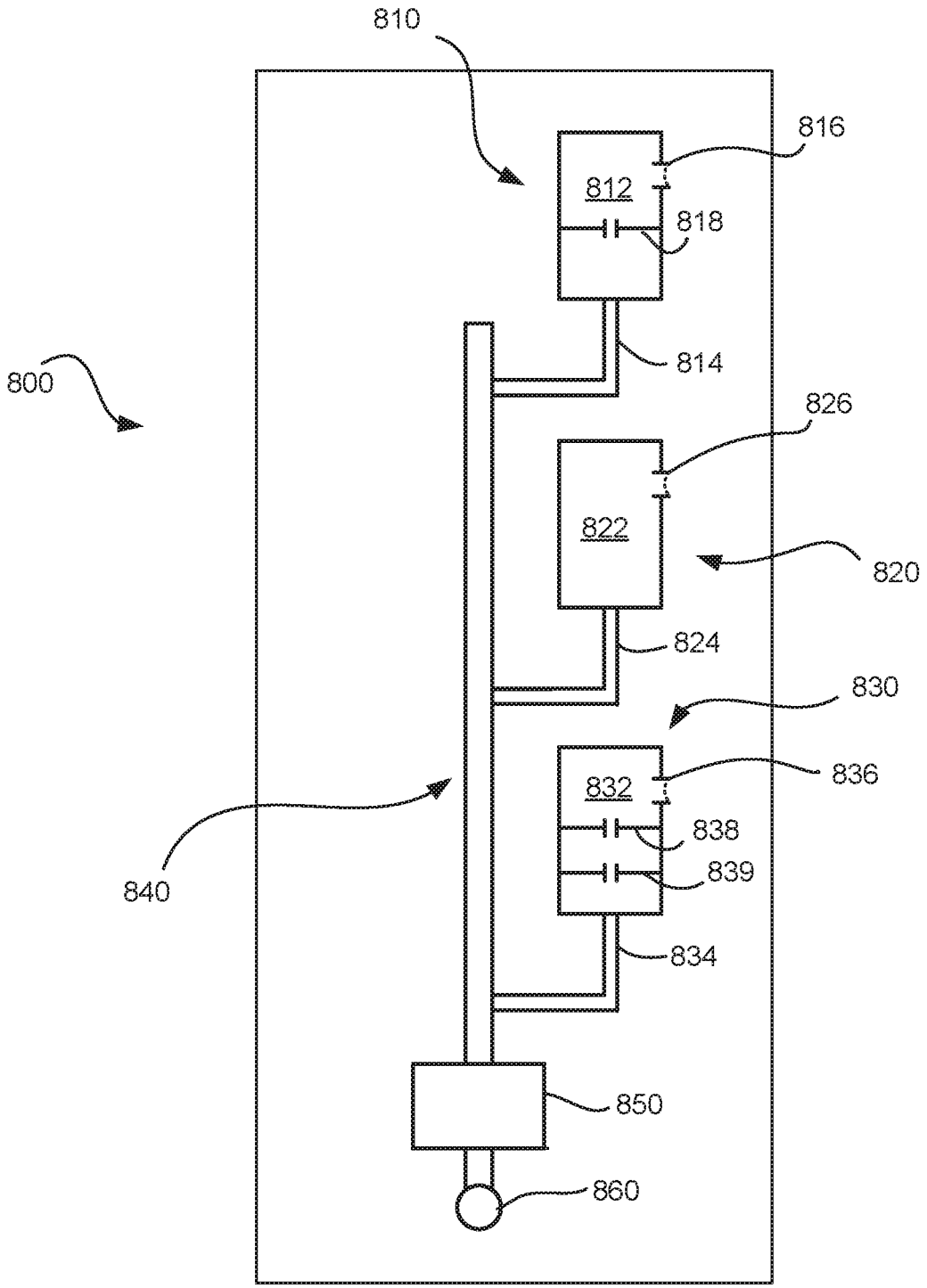
FIG. 8 is a schematic diagram of an example microfluidic device that uses bubblers to provide sequential fluid flow.

FIG. 8 is a schematic diagram of an example microfluidic device 800. The microfluidic device 800 includes a first fluid chamber 810 which is loaded with a first fluid 812, a second fluid chamber 820 which is loaded with a second fluid 822, and a third fluid chamber 830 which is loaded with a third fluid 832. The first, second, and third fluids 812, 822, 832 may be different fluids for carrying out an operation at the microfluidic device 800, such as a biological, chemical, or biochemical process or test. In some examples, the microfluidic device 800 may form part of an inkjet printhead. In some examples, the fluids 812, 822, 832, may include different inks for printing.

The fluid chambers 810, 820, 830 are connected in parallel to a main conduit 840, by branches 814, 824, 834, respectively. The fluids 812, 822, 832 are thereby fluidly connected between the fluid chambers 810, 820, 830, and main conduit 840. Although only a single main conduit 840 is shown, it is to be understood that in other examples the main conduit 840 may represent a capillary network of branching conduits connecting to other components on the microfluidic device 800. The main conduit 840 and branches 814, 824, 834, may include tubes, channels, and the like.

The microfluidic device 800 includes an application region 850 connected downstream to the main conduit 840. The application region 850 may include a channel, chamber, conduit, or network thereof to perform the operation with the fluids 812, 822, 832. The microfluidic device 800 may further include a pump in the form of a droplet ejector nozzle 860, such as a thermal inkjet nozzle (TIJ) or piezoelectric nozzle, connected downstream of the application region 850. The ejector nozzle 860 may be driven to sequentially draw fluid from the fluid chambers 810, 820, 830 into the application region 850 to perform the operation of the microfluidic device 800.

Each fluid chamber 810, 820, 830 may be associated with a main bubbler 816, 826, 836, respectively. Description of the main bubblers 816, 826, 836, may be had with respect to the analogous bubblers 216, 226, and 236, of device 200 in FIG. 2. The main bubblers 816, 826, 836 are open to a common fluid, such as, for example, atmospheric air at atmospheric pressure. In other examples, the common fluid may be any gas or liquid surrounding the fluid chambers 810, 820, 830.

Further, first fluid chamber 810 may include a first intermediate bubbler 818, and the third fluid chamber 830 may include second and third intermediate bubblers 838, 839, respectively. Description of the intermediate bubblers 818, 838, 839, may be had with respect to analogous intermediate bubblers 218, 228 of device 200 in FIG. 2.

Thus, it may be seen from the above that a microfluidic device may include fluid chambers loaded with different fluids and connected in parallel through a conduit. The fluid chambers may include main bubblers and intermediate bubblers set at different bubble pressures so that fluid may be sequentially discharged from the fluid chambers, or sub-chamber thereof, when suction overcomes the bubble pressures of the bubblers.

The bubblers may trigger sequential discharge of the fluids automatically without the need for active switching mechanisms. Cost and complexity of devices involving fluid flow may thereby be reduced.

The invention claimed is:

1. A device comprising:

a first chamber to contain a first fluid, the first chamber including:

a first fluid outlet, and a first bubbler to ingest bubbles into the first chamber when pressure in the first chamber overcomes a first bubble pressure of the first bubbler;

a second chamber to contain a second fluid, the second chamber including:

second fluid outlet; and a second bubbler to ingest bubbles into the second chamber when pressure in the second chamber overcomes a second bubble pressure of the second bubbler, the second bubble pressure being greater than the first bubble pressure; and an outlet node fluidly connected to the first fluid outlet and the second fluid outlet, the outlet node to draw the first fluid from the first chamber when the first bubbler ingests bubbles, and to sequentially draw the second fluid from the second chamber when the second bubbler ingests bubbles.

2. The device of claim 1, further comprising a pump downstream of the outlet node to reduce pressure in the first chamber to overcome the first bubble pressure and to reduce pressure in the second chamber to overcome the second bubble pressure.

3. The device of claim 1:

wherein the first chamber is subdivided into a first sub-chamber including the first bubbler and a second sub-chamber including the first fluid outlet; and wherein the device further comprises a third bubbler, the first and second sub-chambers in fluid communication through the third bubbler, the third bubbler to ingest bubbles from the first sub-chamber when pressure in the second sub-chamber overcomes a third bubble pressure of the third bubbler, the third bubble pressure being greater than the second bubble pressure, the outlet node to draw the first fluid from the second sub-chamber when the third bubbler ingests bubbles.

4. The device of claim 3, herein the third bubbler comprises a mesh.

5. The device of claim 4, wherein the mesh comprises a mesh filter to filter a contaminant from the first fluid when the filter is wetted.

6. The device of claim 1, wherein the first and second bubblers are open to atmospheric pressure.

7. The device of claim 1, wherein the first bubbler comprises an orifice of circular cross-section.

8. A device comprising:

a plurality of fluid communicating chambers;

a plurality of bubblers associated with the plurality of fluid communicating chambers, the plurality of bubblers set at bubble pressures according to a sequence of sequentially increasing bubble pressures;

wherein a first bubbler of the plurality of bubblers is set at a first bubble pressure of the sequence of sequentially increasing bubble pressures to trigger discharge of fluid from a first volume of the plurality of fluid communicating chambers when pressure in the plurality of fluid communicating chambers reaches the first bubble pressure; and wherein a second bubbler of the plurality of bubblers is set at a second bubble pressure of the sequence of sequentially increasing bubble pressures to trigger discharge of fluid from a second volume of the plurality of fluid communicating chambers when pressure in the plurality of fluid communicating chambers reaches the second bubble pressure.

9. The device of claim 8, wherein the first and second volumes of the plurality of fluid communicating chambers are a first chamber and a second chamber of the plurality of fluid communicating chambers, respectively.

10. The device of claim 8, wherein:

the plurality of fluid communicating chambers includes a first chamber, the first chamber divided into first and second sub-chambers in fluid communication through an intermediate bubbler;

the first volume of the plurality of fluid communicating chambers is the first sub-chamber of the first chamber;

the second volume of the plurality of fluid communicating chambers is a second chamber of the plurality of fluid communicating chambers; and the intermediate bubbler is set at an intermediate bubble pressure between the first bubble pressure and the second bubble pressure to retain a third volume of fluid in the second sub-chamber of the first chamber until the first sub-chamber and the second chamber are discharged of fluid.

11. The device of claim 10, wherein the intermediate bubbler comprises a filter.

12. A microfluidic device comprising:

a first fluid chamber loaded with a first fluid, the first chamber including a first bubbler having a first bubble pressure;

a second fluid chamber loaded with a second fluid that is different from the first fluid, the second chamber including a second bubbler having a second bubble pressure that is different from the first bubble pressure;

a conduit, the first and second fluid chambers connected in parallel with the conduit, the conduit including a low-pressure element downstream the first and second fluid chambers; and the first fluid chamber to discharge the first fluid when suction in the first fluid chamber overcomes the first bubble pressure, and the second fluid chamber to discharge the second fluid when suction in the second fluid chamber overcomes the second bubble pressure.

13. The microfluidic device of claim 12, wherein the low-pressure element comprises a pump to generate suction in the first and second fluid chambers.

14. The microfluid device of claim 12, wherein the first and second bubblers are open to a common fluid.

15. The microfluidic device of claim 12, wherein the first fluid chamber is divided into first and second sub-chambers in fluid communication through a third bubbler, the third bubbler having a third bubble pressure to retain a portion of the first fluid in the first fluid chamber until the second fluid is charged from the second fluid chamber.

* * * * *